United States Patent [19]

Godel et al.

[11] 4,085,309

[45] Apr. 18, 1978

[54] CONTROL CIRCUIT ARRANGEMENT FOR A PORTABLE ELECTRICALLY HEATED HAIR TREATMENT APPLIANCE

[75] Inventors: Siegfried Godel, Norwalk; Albert Adam Pudims, Stratford; Richard Wergzyn, Bridgeport, all of Conn.

[73] Assignee: Sperry Rand Corporation, Bridgeport, Conn.

[21] Appl. No.: 583,617

[22] Filed: Jun. 4, 1975

[51] Int. Cl.[2] ..... H05B 1/02; A45D 20/08; F24H 3/04

[52] U.S. Cl. ..... 219/364; 34/48; 34/97; 219/370; 219/501

[58] Field of Search ..... 219/501, 359–382; 34/96–101, 243 R, 48

[56] References Cited

U.S. PATENT DOCUMENTS

| | | | |
|---|---|---|---|
| 3,426,441 | 2/1969 | Broski | 219/364 X |
| 3,497,675 | 2/1970 | Yoshiike et al. | 219/364 UX |
| 3,610,881 | 10/1971 | Stewart | 219/364 X |
| 3,681,569 | 8/1972 | Schwarz | 219/501 X |
| 3,708,650 | 1/1973 | Smillie et al. | 219/501 X |
| 3,731,057 | 5/1973 | Kunz et al. | 219/364 X |

FOREIGN PATENT DOCUMENTS

| | | | |
|---|---|---|---|
| 1,276,251 | 8/1968 | Germany | 219/501 |

*Primary Examiner*—A. Bartis
*Attorney, Agent, or Firm*—Charles R. Miranda

[57] ABSTRACT

An airstream is established and flows about a resistance heater element in an electrical appliance. The heater element is energized by a cyclical potential. A temperature control circuit is provided which includes a switch connected in series with a heat sensor for applying the cyclical potential to the heater. A half-wave rectifier in the control circuit is electrically connected in series with the switch and across the heat sensor. Energization of the heater heats the airstream to an operating temperature $T_1$. The heat sensor is operable to detect an undesired increase in temperature above a safe limit temperature $T_2$ which is greater than $T_1$. At a temperature greater than $T_2$ the heat sensor automatically opens the series circuit to interrupt energization of the heater. During the open circuit condition of the heat sensor the half-wave rectifier is operable for applying half-cycles of the cyclical potential to the heater. The half-cycle energization of the heater heats the airstream at a reduced operating temperature $T_0$ which is less than the operating temperature $T_1$.

5 Claims, 7 Drawing Figures

CONTROL CIRCUIT ARRANGEMENT FOR A PORTABLE ELECTRICALLY HEATED HAIR TREATMENT APPLIANCE

BACKGROUND OF THE INVENTION

This invention relates to improved control circuit arrangements for electrical appliances and more particularly to a circuit arrangement for controlling the operating temperature of an appliance.

In one form of electrical appliance, an electrical resistance heater element is mounted within a casing and an airstream is established which flows through the casing and about the heater element. The airstream which is thus heated is discharged from an outlet aperture of the casing and is utilized for hair treatment by curling, styling, or drying.

An appliance of this type can, at times, experience a malfunction which is caused by a defective component of the appliance. Since this malfunction is generally characterized by an overheating of the appliance, a control circuit is provided for sensing the occurrence of this condition and for automatically de-energizing the appliance. The control circuit includes a thermostat which is positioned in the heated airstream and operates to interrupt the application of an energizing potential to the heater element. This operation of the thermostat disables use of the appliance and the user properly seeks service to correct the malfunction.

It has been found however that the overheating which is generally characteristic of a malfunction can also occur in the absence of a malfunction. This has been found to be the case, for example, when the airstream is temporarily restricted by means external to the appliance. A substantially reduced airflow without concurrent reduction in electrical energization of the heater results in overheated operation of the appliance. This condition occurs frequently in hair treatment devices when hair strands gather at an airstream inlet or outlet to the casing and create a restriction to airflow. The airstream which thus overheats causes the thermostat to interrupt energization of the heater. While the simple removal of the inlet blockage will correct overheating and reestablish normal operating conditions, the appliance user at times is confused with the reaction of the appliance under these conditions. Consequently, the user generally initiates unnecessary and costly service examinations of the appliance which are an inconvenience to the user and an expense to the manufacturer.

Accordingly, it is an object of this invention to provide an improved control circuit arrangement for an electrical appliance.

Another object is to provide an improved control circuit arrangement for automatically reducing energization of a heater upon overheating of the appliance;

Another object is to provide an improved control circuit arrangement which automatically reduces the energization of the heater upon airstream blockage.

SUMMARY OF THE INVENTION

In accordance with features of this invention, a heater control for an electrical appliance includes a casing and a resistance heater positioned in the casing. A means is mounted in the casing for establishing an airstream which flows about the heater and is exhausted from an outlet of the casing. Circuit means apply a cyclical energizing potential to the heater for heating the airstream to an operating temperature $T_1$. A temperature control circuit means detects an increase in the temperature of the airstream to a relatively higher limit temperature, $T_2$ and automatically reduces the energization of the heater during each cycle of energization when the airstream exceeds the limit temperature $T_2$. In a particular embodiment of the invention, the heater energizing means applies an alternating potential to the heater and the temperature control circuit means includes a rectifying means for applying halfwave energization to the heater.

These and other objects and features of the invention will become apparent with reference to the following specification and the drawings.

THE DRAWINGS

Figure 3:
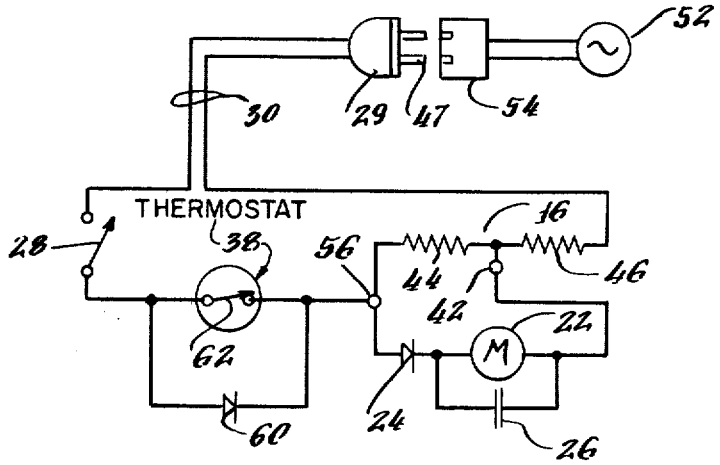
FIG. 3 is a circuit diagram illustrating one embodiment of a temperature control circuit diagram utilized with the appliance of FIG. 1.
Figure 4A:
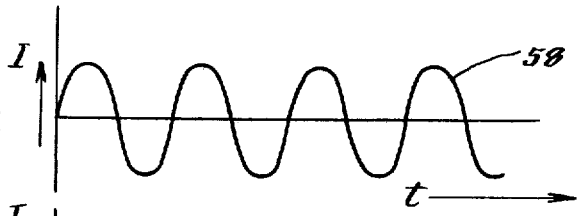

FIG. 4*a* is a diagram illustrating a waveform of current flowing in a resistance heater circuit element of FIG. 3 during one mode of operation.

Figure 1:
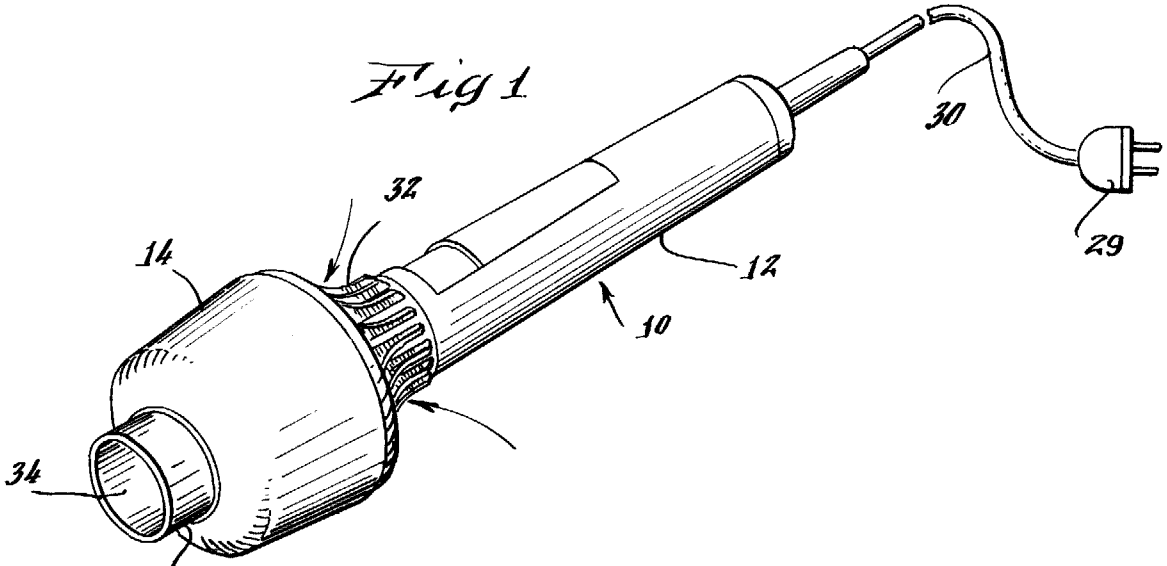
FIG. 1 is a perspective view of an electrical appliance constructed in accordance with features of this invention.
Figure 4B:
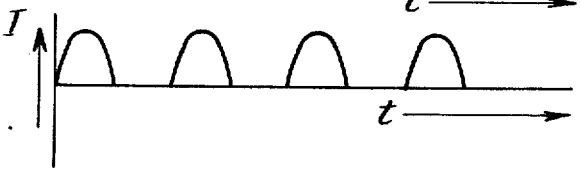
Figure 5:
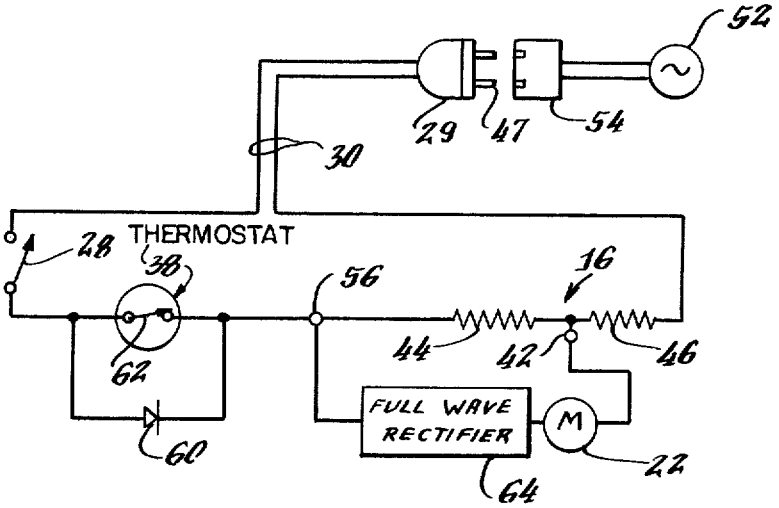
Figure 6:
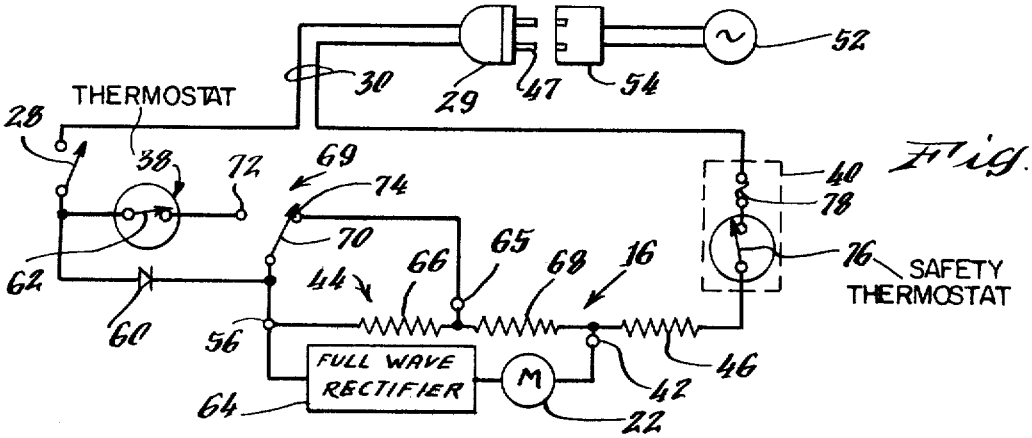

FIG. 4*b* is a diagram illustrating the waveform of current flowing in the resistance heater element of FIG. 3 during another mode of operation;

FIG. 5 is an alternative embodiment of a temperature control circuit arrangement for use with the appliance of FIG. 1; and, FIG. 6 is a further embodiment of a temperature control circuit arrangement for use with the appliance of FIG. 1.

Figure 2:
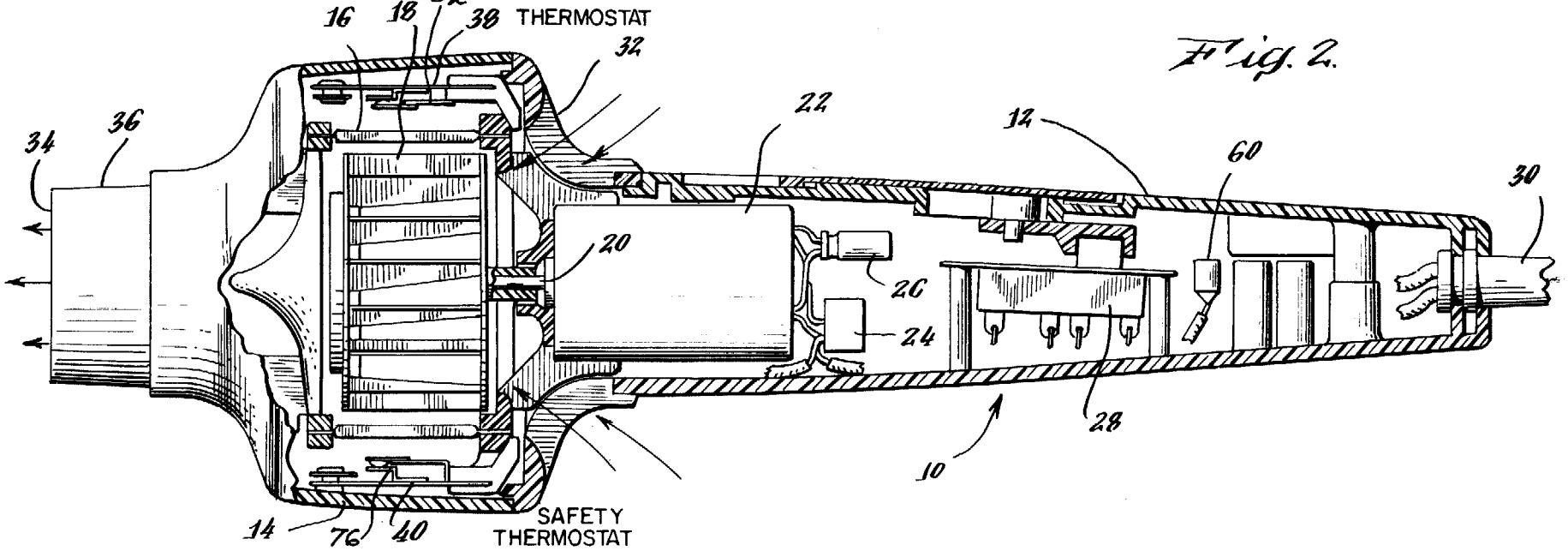
FIG. 2 is a side elevation view, partly cut away and partly in section, of the appliance of FIG. 1.

Referring now to FIGS. 1 and 2 of the drawings, an electrical, appliance is shown to comprise a hair treatment device, indicated generally by reference numeral 10, which is adapted for the styling, curling, and drying of hair arrangements. The appliance includes a casing having a handle segment 12 and a heater-blower housing segment 14. There is positioned within the casing segment 14 an electrical resistance heater element 16 which is mounted concentrically with a rotatable impeller 18. The impeller 18 is mechanically coupled by a drive shaft 20 to a direct current motor 22 which is mounted in the handle segment 12 of the casing. A rectifier 24 and a capacitor 26, both of which are described in greater detail hereinafter, are provided for converting an alternating energizing potential to a d.c. operating potential for the motor. A manually operable slide switch 28 is positioned in the handle segment 12 for applying an alternating energizing potential to the various operating components of the appliance. An alternating potential is applied to the appliance from a line source through a plug 29 and power cord 30.

When the switch 28 is actuated to either one of two operating positions as is described in more detail hereinafter, both the heater 16 and the motor 22 are energized. The impeller 18 therefore rotates and established an airstream in the casing which enters through an inlet grill 32, flows about the electrical resistance heater element 16 by which it is heated and is exhausted from the casing at an outlet aperture 34 thereof. Within the casing segment 14 the heated airstream flows over a first thermostat 38 and a thermostat and fuse assembly 40 which are mounted in the casing segment and which are described in detail hereinafter. The outlet aperture 34 is formed in a tubular shaped casing segment 36 which is adapted to receive various appliance implements, which for purposes of clarity in the drawings, are not illustrated, but which are provided for curling, styling, or drying of a hair arrangement.

A control circuit arrangement for controlling the energization of the heater 16 and the blower 18 is illustrated in FIG. 3. The circuit components of FIG. 3 which were illustrated in FIG. 2 bear the same reference numerals. A circuit means for applying a cyclical energizing potential to the heater 16 in order to provide a heated airstream at an operating temperature $T_1$ includes a switch 28, the thermostat 38 whose contacts are normally closed and establish continuity across the thermostat, and the illustrated wiring which intercouples the switch 28, the thermostat 38, and the heater 16 in a series circuit arrangement. This series circuit arrangement is coupled to connector pins 47 of a plug 29 to which a cyclical potential is applied. The cyclical potential comprises a 60 cycle potential of 115 volts which is derived from a source 52 and is applied to the pins 47 of the plug 29 through a mating female socket 54.

Fabrication cost factors render it desirable to employ a low voltage, permanent magnet, D.C. motor 22 for driving the impeller 18. A relatively low D.C. voltage for energizing the motor 22 is provided by tapping across the heater 16 and by rectifying the tapped alternating voltage. Resistance heater 16 is shown to include a tap 42 which divides the heater into heater segments 44 and 46. The motor circuit is coupled between the heater tap 42 and a heater terminal 56. An A.C. voltage existing between these terminals has a magnitude which is less than and is proportional to the magnitude of the voltage of the source 52 by a ratio of the resistance, i.e. $R_{44}/R_{44}+R_{46}$. This voltage is rectified by a halfwave rectifier circuit comprising the diode 24 and capacitor 26 and is applied to the motor 22.

In operation, a cyclical heater current as illustrated by the sinusoidal curve 58 of FIG. 4*a* flows in the heater 16. The resistance heater 16 is selected to have a resistance R which at the operating potential provides a desired power dissipation $P = I^2_{RMS} \times R$. This power dissipation heats the resistance element to a temperature which, in conjunction with the airstream flowing about the heater, heats the airstream and causes the air to flow from the outlet aperture 34 (FIG. 1) at a desired operating temperature $T_1$. At the operating temperature $T_1$ the thermostat 38 which includes a conventional bimetal sensing element exhibits continuity in that its contacts are closed and a low resistance path is provided between the terminal 56 and the switch 28. However, when a flow restriction occurs in the airstream such as may be caused by hair strands gathering about the inlet 32, the flow rate of air through the casing is reduced while the electrical energy dissipated by the heater element 16 is maintained substantially constant. Consequently, the relatively low mass of air flowing about the heater 16 is undesirably heated to a higher temperature. This is undesirable since continued operation at elevated temperatures can result in deterioration of the various components of the appliance.

In accordance with a feature of this invention, a circuit means is provided for detecting an increase in the temperature of the airstream to a safe limit temperature $T_2$ and for automatically reducing energization of the heater 16 during each cycle of energization when the airstream exceeds the temperature limit $T_2$. This means is shown in FIG. 3 to comprise the thermostat 38 and a rectifying means comprising a diode 60. A contact element 62 of the thermostat 38 is adapted for providing continuity between the switch 28 and the heater terminal 56 at the normal operating temperature $T_1$ and at temperatures up to the safe limit temperature $T_2$. At this safe limit temperature $T_2$, the contact member 62 interrupts continuity between the switch 28 and the terminal 56 and establishes a relatively high impedance to the flow of current through this thermostat. Since the forward resistance of the diode 60 is substantially less than the open circuit impedance of the thermostat 38, a current will flow through the diode 60 and through the heater 16 on positive alternations of the applied sinusoidal potential. Now however, the current flowing through the heater element 16 is a rectified current as is illustrated by the waveform of FIG. 4*b*. In the case of a cyclical alternating current having a sinusoidal waveform 58 as employed herein, the heating effect of the rectified current of FIG. 4*b* is 50% of the heating effect provided by the current of FIG. 4*a*. The thermostat 38 thus operates to automatically enable the operation of the diode 60 and reduce energization of the heater during each cycle of energization. This reduced energization results in a reduction of appliance temperature and upon reduction of the airstream temperature to a temperature below the safe limit temperature $T_2$, the thermostat contact 62 will provide continuity and disable the operation of the diode 60. Full power is then automatically reapplied to the heater.

It is desirable that the motor 22 operate at substantially the same RPM when the energization of the heater 16 is automatically reduced. It will be noted in FIG. 3 that the rectifier employed for converting the A.C. potential to a D.C. potential for the motor 22 comprises a halfwave rectifier which is coupled in circuit with the same polarization as the diode 60. When the sinusoidal alternating current 58 of FIG. 4*a* flows in the heater 16, energy is derived from the heater 16 during positive alternations of the current at the terminal 56. When the diode 60 is automatically coupled into circuit at temperatures above the safe limit temperature $T_2$, current having the waveform of FIG. 4*b* will flow in the heater 16 and the motor rectifier circuit will similarly derived energy during the positive alternations of this waveform. Thus, no variation in the energization of the motor circuit occurs with the operation of the thermostat 38 and the motor will maintain a relatively constant RPM both at temperatures below and above the safe limit temperature $T_2$.

Because of its superior speed regulating characteristics, it is at times desirable to employ a fullwave rectifier in the motor energization circuit. FIG. 5 illustrates an arrangement of this type wherein the rectifier comprises a fullwave rectifier which is represented by the rectangle 64. Since the fullwave rectifier derives energy for the motor 22 during both positive and negative alternations of the waveform 58, a decrease in speed of the motor 22 will be experienced upon automatic operation of the thermostat 38 at temperatures above the safe limit temperature $T_2$. However, it has been found that the motor speed does not decrease in correspondence with the heater energization but rather reduces by a smaller factor which is acceptable in most instances.

The embodiment of FIG. 6 illustrates a control circuit arrangement for a hair treatment device having DRY and STYLE modes of operation. Heater segment 44 is tapped at a terminal 65 for dividing the heater segment 44 into subsegments 66 and 68. The heater 16 now includes three segments which, as indicated hereinafter, are provided for selectively changing the speed of the motor 22 and reducing power dissipation in the STYLE mode. A switch, indicated generally as 69, and which is incorporated into the slide switch 28 of FIG. 2, includes a contact member 70 and terminals 72 and 74. This portion 69 of the switch 28 is provided for selecting alternative DRY and STYLE operating modes. In addition, the safety fuse-thermostat assembly 40 of FIG. 2 is shown to include a thermostat member 76 and a fuse member 78 which are coupled in series with the heater 16.

In a DRY mode of operation, the switch contact member 70 contacts terminal 72 and alternating energy is applied to each of the segments 66, 68 and 46 of the heater 16. The temperature control circuit arrangement, including the thermostat 38 and the diode 60, operate as described hereinbefore and fullwave rectification is provided by the recitifier circuit 64 for the motor 22. An operating airstream temperature $T_1$ is established and the temperature control circuit becomes operative at airstream temperatures above the temperature $T_2$. In addition, the thermostat member 76 is selected to interrupt continuity and to de-energize the entire circuit when the airstream temperature attains an unsafe temperature $T_3$ which is greater than the temperature $T_2$. The fuse member 78 is additionally provided for interrupting power to the entire circuit arrangement when unsafe current surges occur and to which the thermostat 76 cannot rapidly respond or fails to respond.

Operation of the arrangment of FIG. 6 in the style mode is effected by causing the switch member 70 to contact terminal 74. Under these conditions, the thermostat 38 is decoupled from the circuit and becomes inoperative for enabling or disabling the rectifying operation of the diode 60 while the switch member 70 operates to shunt the segment 66 of the resistance heater 16. Energization of the heater 16 is thus reduced by the application of the energizing potential to the heater 16 through the diode 60 and the motor energization circuit arrangement is effectively coupled in parallel only with the heater segment 68. A relatively lower motor energization potential is provided for establishing a relatively lower motor speed. Thus, in the STYLE mode of operation, the heater 16 provides less resistive impedance for dissipating energy; the energy which is applied to the resistance is reduced by virtue of the rectification; and the motor 22 operates at a reduced RPM with respect to its rate in the DRY mode. Under these conditions, the airstream operating temperature is reduced to a value $T_0$ which is less than the operating temperature $T_1$, of the DRY mode of operation. Since the temperature control circuit arrangement described hereinbefore is inoperative in the STYLE mode of operation, a safety thermostat function is provided by the thermostat 76. As indicated, this thermostat 76 is operative to sense an unsafe temperature $T_3$ and to interrupt the application of energy to the circuit when such temperature is attained.

An improved heater control for an electrical appliance has thus been described which advantageously reduces power supplied to an electrical resistance heater when an obstruction in the airstream occurs. The control circuit automatically restores the full operating power to the heater when the obstruction has been removed and relatively costly and unnecessary service procedures are avoided while inconvenience to the appliance user is substantially reduced. A circuit arrangement for providing a dual mode of operation for the appliance is also described which includes an improved means for providing reduced heater power and reduced speed during one mode of operation.

While there has been described various embodiments of my invention, it will be apparent to those skilled in the art that modifications may be made thereto without departing from the spirit of the invention and the scope of the appended claims.

We claim:

1. An improved heater control for an electrical appliance comprising, a. an appliance casing having an air inlet and an air outlet, b. means positioned in said casing for establishing an airstream from said inlet through said casing to said outlet, c. an electrical resistance heater positioned within the casing in said airstream, d. means including a switch means for applying an alternating potential to energize said heater to heat the airstream to an operating temperature $T_1$, e. means within the airstream for sensing the heat of the airstream and electrically connected in series circuit with said switch means, said sensing means being operable to automatically open said series circuit to interrupt said alternating potential energization of the heater when said operating temperature exceeds a safe limit temperature $T_2$ which is greater than temperature $T_1$, and f. half-wave rectifier means electrically connected across said sensing means for applying half-cycles of the applied alternating potential to the heater during said open circuit condition of the series circuit.

2. The heater control of claim 1 wherein the switch means includes manually operable first and second contact members, said first contact member electrically connected in series with the sensing means, said second contact member being selectively operable to electrically connect said sensing means in series with the heater or to decouple the sensing means and electrically connect a portion of the heater in series with said half-wave rectifier means for applying half-cycles of the applied alternating potential to the heater to heat the airstream to a reduced operating temperature, $T_0$ which is less than temperature $T_1$.

3. The heater control of claim 2 wherein a second sensing means in the airstream is coupled in series circuit with the heater for automatically opening said heater series circuit to interrupt energization of the heater when the airstream exceeds a temperature $T_3$ which is greater than temperature $T_2$.

4. The heater control of claim 1 wherein said sensing means includes a bimetallic thermostat and said half-wave rectifier means comprises a semiconducting diode.

5. A hand-held portable electrically energized hair treatment appliance comprising, a. an appliance casing having an airstream inlet and outlet aperture thereof, b. an electrical resistance heater positioned in said casing, c. an impeller positioned in said casing, d. a direct current motor positioned in said casing and energizable from a source of direct current power, said motor mechanically coupled to said impeller for causing rotary motion of said impeller when said motor is energized to establish an airstream in said appliance which airstream exhausts from said outlet aperture, e. circuit means including a manually operable switch in series circuit with a thermostat located in the airstream for applying an alternating potential to energize the heater for heating the airstream to to operative temperature $T_1$, said thermostat opening said series circuit to interrupt the energization of the heater upon sensing heat in the airstream exceeding a safe limit temperature $T_2$ which is greater than temperature $T_1$, f. a half-wave rectifier electrically coupled in parallel across the thermostat for applying half-wave alternating potential to the heater when the thermostat opens said series circuit and said thermostat operable to close the series circuit and disable said rectifier at airstream temperatures below temperature $T_2$.

* * * * *